US006736761B2

(12) United States Patent
Huang

(10) Patent No.: US 6,736,761 B2
(45) Date of Patent: May 18, 2004

(54) STATIONARY BICYCLE RESISTANCE GENERATOR

(76) Inventor: Wan-Fu Huang, No. 35, Chung Jeng Rd., Ming Hsiung Industrial Park, Chia Yi County (TW)

( * ) Notice: Subject to any disclaimer, the term of this patent is extended or adjusted under 35 U.S.C. 154(b) by 272 days.

(21) Appl. No.: 09/985,916

(22) Filed: Nov. 6, 2001

(65) Prior Publication Data

US 2003/0087731 A1 May 8, 2003

(51) Int. Cl.[7] ..... A63B 69/16
(52) U.S. Cl. ..... 482/57; 482/61; 482/63
(58) Field of Search ..... 482/51–65, 110, 482/903, 908, 909

(56) References Cited

U.S. PATENT DOCUMENTS

RE34,479 E * 12/1993 Minoura ..... 482/61
5,468,201 A * 11/1995 Minoura ..... 482/61
5,728,029 A * 3/1998 Minoura ..... 482/61
5,944,637 A * 8/1999 Stickler et al. ..... 482/61
6,042,517 A * 3/2000 Gunther et al. ..... 482/57

* cited by examiner

*Primary Examiner*—Nicholas D. Lucchesi
*Assistant Examiner*—Tam Nguyen
(74) *Attorney, Agent, or Firm*—Charles E. Baxley

(57) ABSTRACT

A resistance generator adapted to a stationary bicycle exerciser to produce resistance when driven by cycling essentially comprised of a support unit, a transmission unit and a magnetism controlled unit; within, said magnetism controlled unit containing multiples of magnet arranged in circular being provided to a fixation disk and connected with an aluminum disk to a transmission shaft in the transmission unit; and resistance being produced by vortex magnetic loss resulted from those magnets positioned in relation to the rotating aluminum disk as driven by a wheel.

10 Claims, 7 Drawing Sheets

STATIONARY BICYCLE RESISTANCE GENERATOR

BACKGROUND OF THE INVENTION (a) Field of the Invention

The present invention relates to a resistance generator adapted to a stationary bicycle exerciser, and more particularly, to one that generates resistance by vortex-induced magnetic loss during the cycling driven by rear wheel of the bicycle.

(b) Description of the Prior Art

Referring to FIG. 1 of the accompanying drawings, a resistance generator of the prior art is adapted to a bicycle exerciser as disclosed in U.S. Pat. No. 4,826,150 essentially comprised of a main support frame 10, a girder frame 20 each respectively connected to both ends of the main support frame 10, a telescopic shaft 30 vertically erected into the main support frame 10, and a head tube 40 connected at a certain inclination to a front wheel. When the bicycle exerciser is lifted off the ground by the telescopic shaft 30 and the head tube 40, the resistance generator 50 adapted to the rear end of the main support frame 10 contacts and is driven by a rear wheel of the bicycle exerciser to produce resistance.

As illustrated in FIG. 2, said resistance generator 50 by having provided an iron disk 502 and an aluminum disk 503 at an end of a transmission shaft 501, and multiple magnets 504 fixed to the front of said iron disk 502. Magnetic north and south poles of those magnets are interlaced with one another. Said aluminum disk 503 is placed in front of those magnets 504. Another iron disk 506 allowing micro-adjustment is provided inside an outer cover 505 on one side of the resistance generator 50, and multiple magnets 507 with their magnetic north and south poles are also fixed to the front of the iron disk 506. Both groups of magnets 504 and 507 are disposed relatively on both sides of the aluminum disk 503. Once the rear wheel cycles to drive the iron disk 502 and those magnets 504 via the transmission shaft 501, the resistance is produced due to rejection by opposite magnetism from those magnets 507.

However, the bicycle exerciser generally available in the market today consumes too much space and takes two groups of magnet to produce resistance making it a problem for use and storage and more complicate in the manufacturing process to produce the resistance generator.

SUMMARY OF THE INVENTION

The primary purpose of the present invention is to provide a resistance generator for a stationary bicycle that produces resistance by vortex magnetic loss. To achieve the purpose, the resistance generator is comprised of a support unit, a transmission unit and a magnetism-controlled unit. In the magnetism-controlled unit, multiple magnets are arranged in a circle with interlaced north and south poles on one side of a fixation disk and linked with an aluminum disk with a transmission shaft from the transmission unit. As is those magnets on the fixation disk are disposed in relation to said aluminum disk, said aluminum disk and those magnets create vortex magnetic loss to produce the resistance when a wheel is cycling to drive said aluminum disk to rotate via the transmission shaft. In turn, the resistance is generated for a rider of the stationary bicycle to achieve fitness training effects.

Another purpose of the present invention is to provide a resistance generator of a stationary bicycle with the resistance adjustable. To achieve this purpose, a right support disk is provided to the support unit and one or more than one slope is provided on the flange of the right support disk. An elastic member is provided behind the fixation disk from the magnetism-controlled unit and an ear is provided on the upper edge of said elastic member. Said ear penetrates the slope on the flange of the right support disk to be linked to a control button for adjusting the spacing between the fixation disk and the aluminum disk, thus to vary the amount of the resistance.

Another purpose yet of the present invention is to provide a resistance generator that has provided at its bottom a frame to lift the rear wheel of the stationary bicycle off the ground for the rear wheel merely contacts the transmission unit to drive the aluminum disk to rotate.

DETAILED DESCRIPTION OF THE PREFERRED EMBODIMENTS

Figure 5:
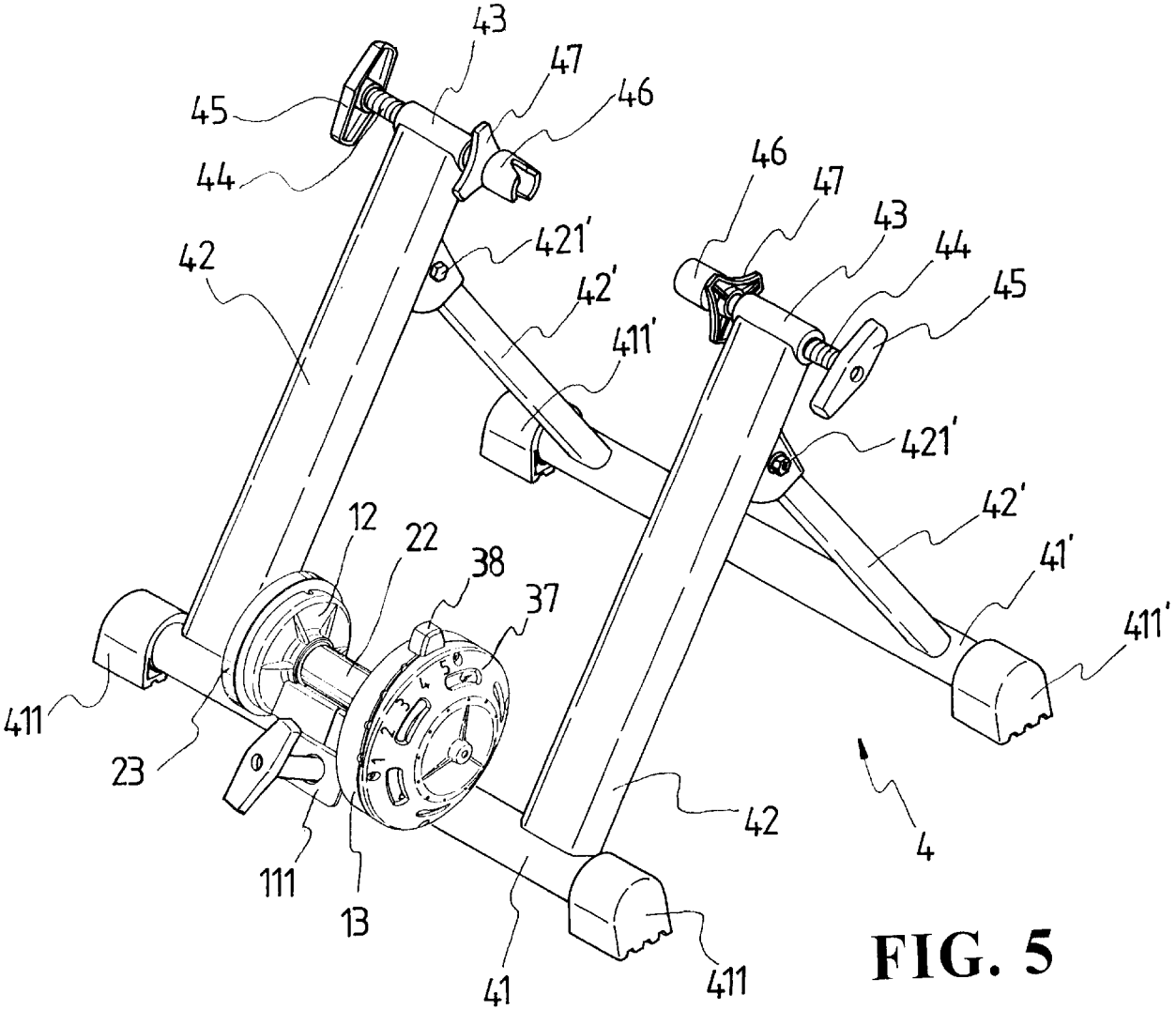
FIG. 5 is a schematic view showing that the preferred embodiment of the present invention is applied to a stationary bicycle.
Figure 6:
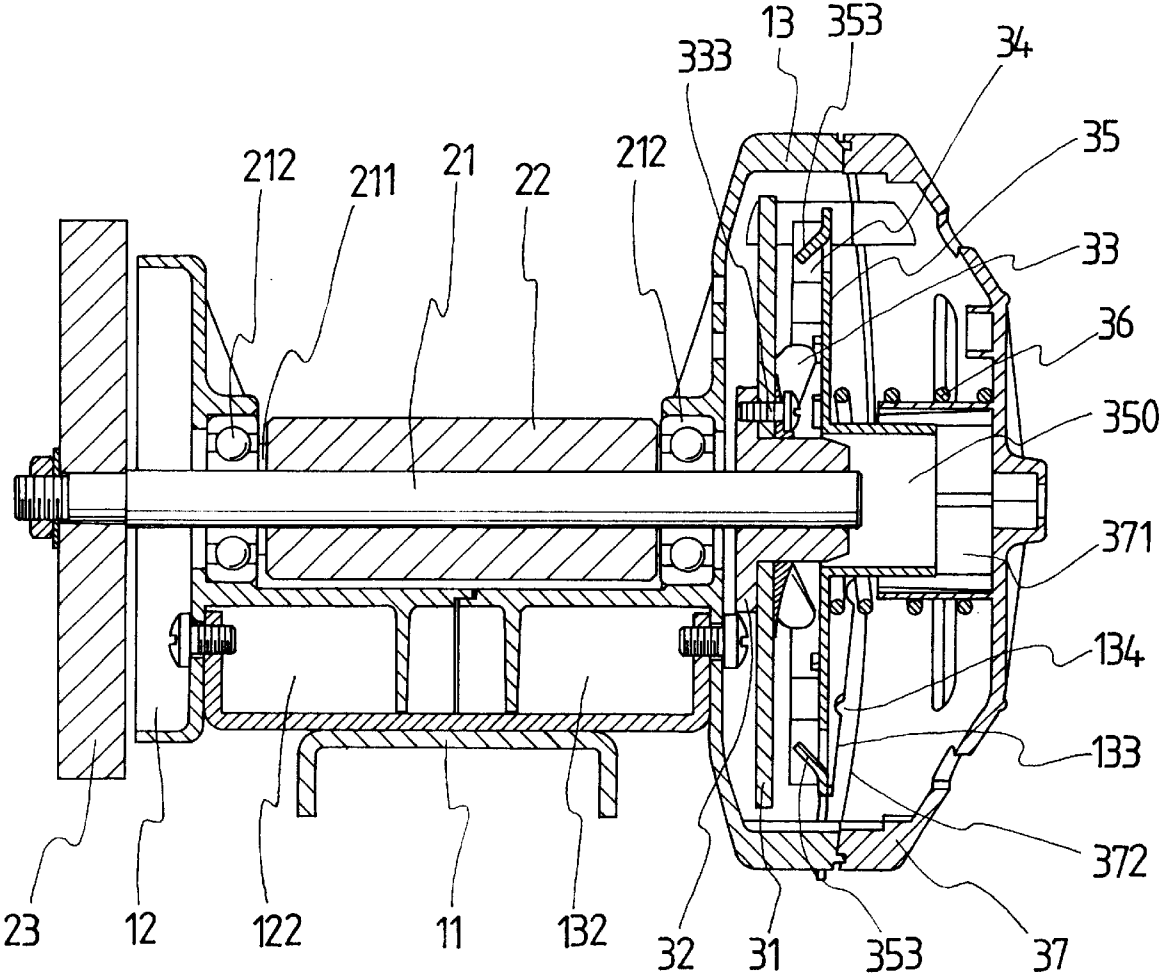
FIG. 6 is a sectional view of the assembly of the preferred embodiment of the present invention.

Referring to FIGS. 3 through 7, a preferred embodiment of the present invention is essentially comprised of a support unit 1, a transmission unit 2, a magnetism-controlled unit 3 and a frame 4. Within, said support unit 1 including a base plate 11, a left support disk 12 and a right support disk 13 is provided to support the transmission unit 2. Said base plate 11 in a shape of a staple (Π) has provided on its front end a T-shape tab 111. A connection bit 112 is each upward folded respectively from both sides on the upper end of said T-shape tab 111. An axial hole 121 is provided at the center of, and a positioning block 122 is formed in the lower part behind said left support disk 12. An axial hole 131 is provided at the center of, and a positioning block 132 is formed in the lower part behind said right support disk 13. One or more than one slope 133 is provided on a flange of the front of said right support disk 13 and multiple recesses 134 are provided at equal spacing on said slope 133. Then, both of said positioning blocks 122, 132 respectively provided behind the left support disk 12 and the right support disk 13 are abutted on the T-shape bit of the base plate 11. Finally, both of said left and right support disks 12, 13 are respectively connected with screws to both of said positioning blocks 122, 132 through said two connection bits 112 provided on both sides of the T-shape tab 111 as illustrated in FIG. 6.

Said transmission unit 2 is essentially comprised of a transmission shaft 21 having provided at its middle section a cylindrical friction roller 22. Said friction roller 22 is fixed to the transmission shaft by screwing in a countersunk bolt 222 through a screw hole 221 provided sideways on the friction roller 22. Both ends of the transmission shaft 21 are respectively inserted with a washer 211 and a bearing 212. A fly wheel 23 to the rear end of the transmission shaft 21 to ensure its firm and consistent turning.

Said magnetism-controlled unit 3 for producing the resistance includes an aluminum disk 31, a fixation ring 32, a fan 33, multiple magnets 34, a fixation disk 35, an elastic member 36, a cover 37 and a control button 38. Within, a through hole 311 is provided at the center of said aluminum disk 31 and multiple holes 312 to permit light are provided in the circumference of said through hole 311. Said fixation ring 32 in a cylindrical shape has provided at its rear end a flange 321. Multiple screw holes 322 to match those holes 312 in the aluminum disk 31 are provided on the surface of the flange 321 for the fixation ring 32 to be inserted into the aluminum disk 31 via the through hole 311. Said fan 33 has multiple blades on its surface and an axial hole 331 at its center to allow insertion by the fixation ring 32. Multiple through holes 332 to match those holes in the aluminum disk 31 are provided around the axial hole 331 for said fan 33 to be fixed to the front of the aluminum disk 31 by means of multiple bolts 333. Those magnets 34 each indicating rectangular sheet are arranged in circular with interlaced north and south poles. Said fixation disk 35 related to an iron disk has a sleeve 350 protruding from its rear side, and two ears 351, 352 respectively protruding from its upper and lower ends. Said ear 351 is fixed into a control button 38, which is related to a rectangular block. Multiple positioning tabs 353 are provided on the front surface of the fixation disk 35 to restrict and hold those magnets 34 in position. Said elastic member 36 related to a compression coil is inserted onto the outer circumference of the sleeve 350 protruding from the center of the fixation disk 35 to press against it forward. Said cover 37 in a disk shape has at its inner center protruding a sleeve 371 and one or more than one slope 372 is provided on its flange in relation to the slope 133 provided on the right support disk 13. Said cover 37 has its sleeve 371 to insert into the elastic member 36 and the sleeve 350 of the fixation disk 35 as illustrated in FIG. 6.

Now referring to FIG. 5, said frame 4 provided to lift the stationary bicycle out of the ground is comprised of two lateral rods 41, 41' at the bottom with both ends of each lateral rod respectively protected by a dust cover 411, 411'. Two struts 42, 42' are provided to both ends of both lateral rods 41, 41' with said two struts 42' each pivoted to approximately the middle of each strut 42 and linked with a bolt 421' to make the frame 4 foldable. Both struts 42 to the lateral rod 41 are respectively provided with a lateral tube 43 and a threaded rod 44 to be inserted from the outer end into the inner end of the lateral tube 43. A knob 45 is fixed to the outer end and a retaining sleeve 46 is provided to the inner side of the threaded rod 44. A fixation knob 47 approximately in triangle is screwed to the threaded rod 44 behind the retaining sleeve 46 for the knob 45 to turn the threaded rod 44, thus to control the relative tightening by the retaining sleeve 46. Furthermore, the threaded rod 44 being held in position by the fixation knob 47 is prevented from loosening.

Figure 1:
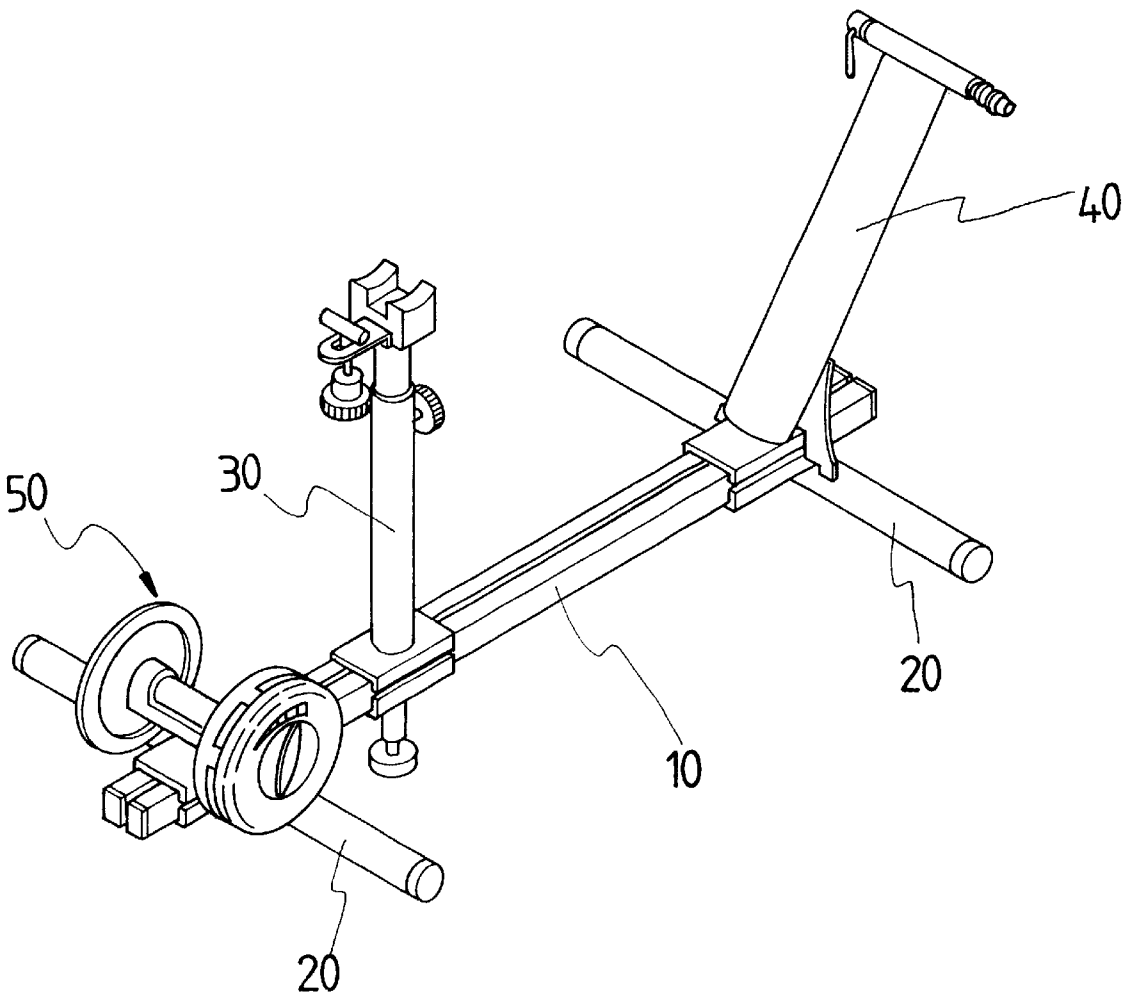
FIG. 1 PRIOR ART
FIG. 1 is a perspective view of an assembly of a prior art of the present invention.
Figure 2:
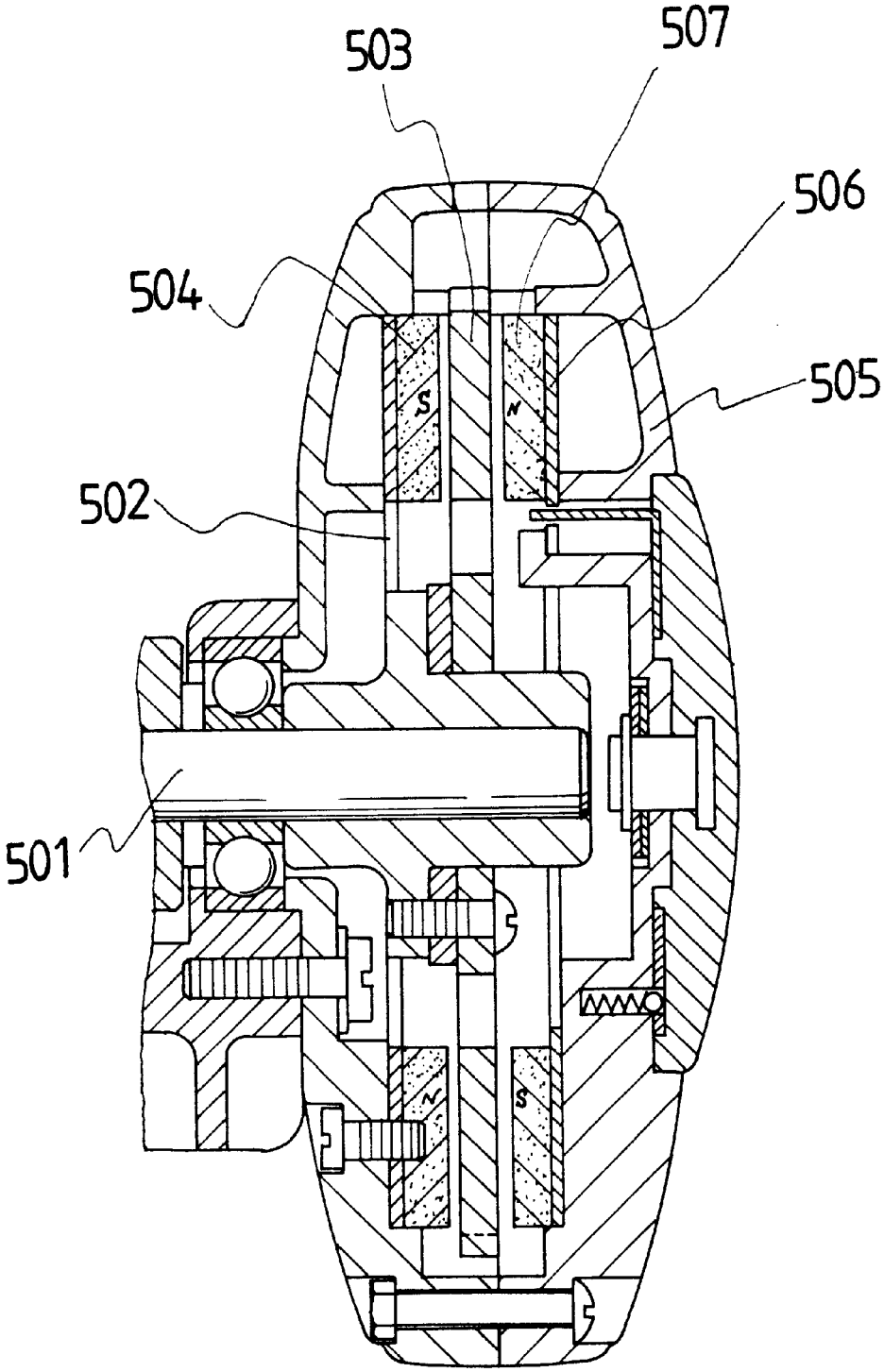
FIG. 2 PRIOR ART
FIG. 2 is a sectional view of a local part of the prior art of the present invention.
Figure 3:
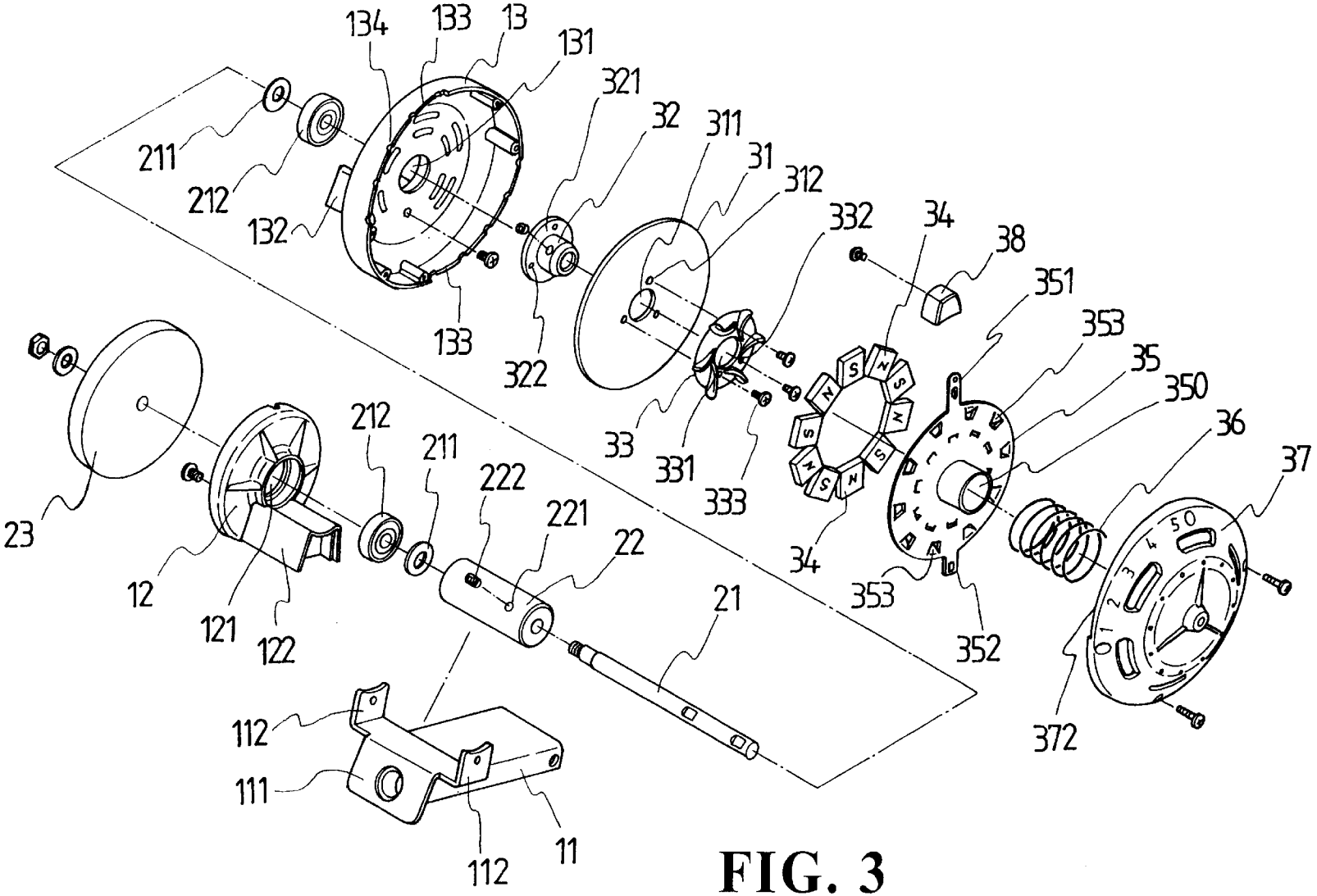
FIG. 3 is an exploded view of a preferred embodiment of the present invention.
Figure 4:
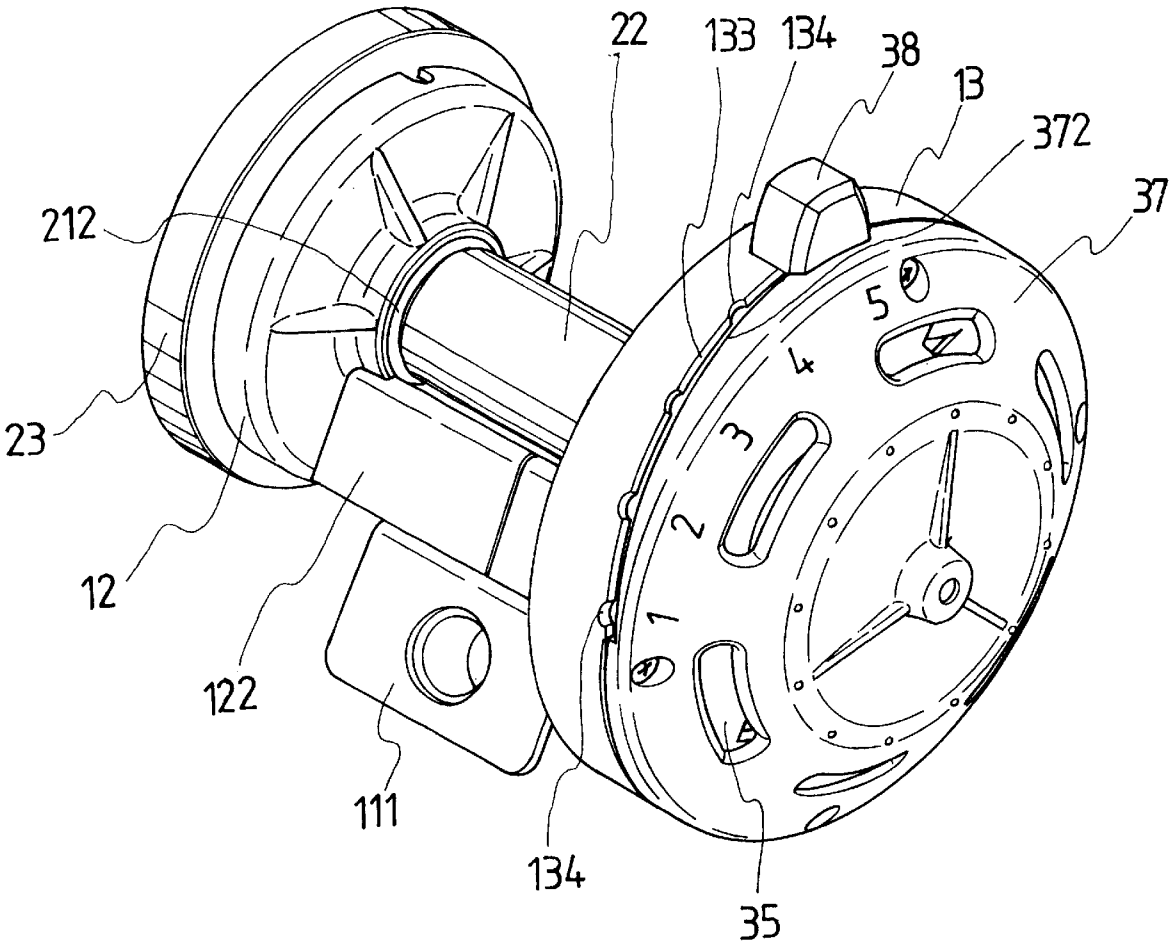
FIG. 4 is a perspective view of an assembly of the preferred embodiment of the present invention.

As illustrated in FIG. 3 or FIG. 6, the stationary bicycle comprised of the support unit 1, the transmission unit 2, the magnetism-controlled unit 3 and the frame 4 has the bearings 212 to the both ends of the transmission shaft 21 of the transmission unit 2 respectively to be provided through the axial holes 121, 131 of the left and the right support disks 12, 13. One end of the transmission shaft 21 passes through the left support disk 12 to connect the fly wheel 23 on the outer side of the left support disk 12 while the other end of the transmission shaft 21 passes through the right support disk 13 for the transmission shaft 21 and the friction roller 22 to turn in the middle of the support unit 1. Said magnetism-controlled unit 3 is fixed to one end of the transmission shaft 21 inside the right support disk 13 with the fixation ring 32 so that both of the aluminum disk 31 and the fan 33 to the fixation ring 32 are driven to turn. Said cover 37 is fixed in relation to the right support disk 13 and one or more than one slot is respectively formed on the slopes 133, 372 provided on the flanges of the right support disk 13 and the cover 37 to allow penetration by the upper ear 351 protruding from the fixation disk 35 and the control button 38 to be provided above the magnetism-controlled unit 3. A spacing is formed to the front magnets 34 in relation to the aluminum disk 31 as the elastic member 36 holds against the fixation disk 35 inside the cover 37. By means of said spacing, the base plate 11 of the support unit 1 is fixed to one lateral rod 41 of the frame 4 to install the present invention to the stationary bicycle.

Figure 7:
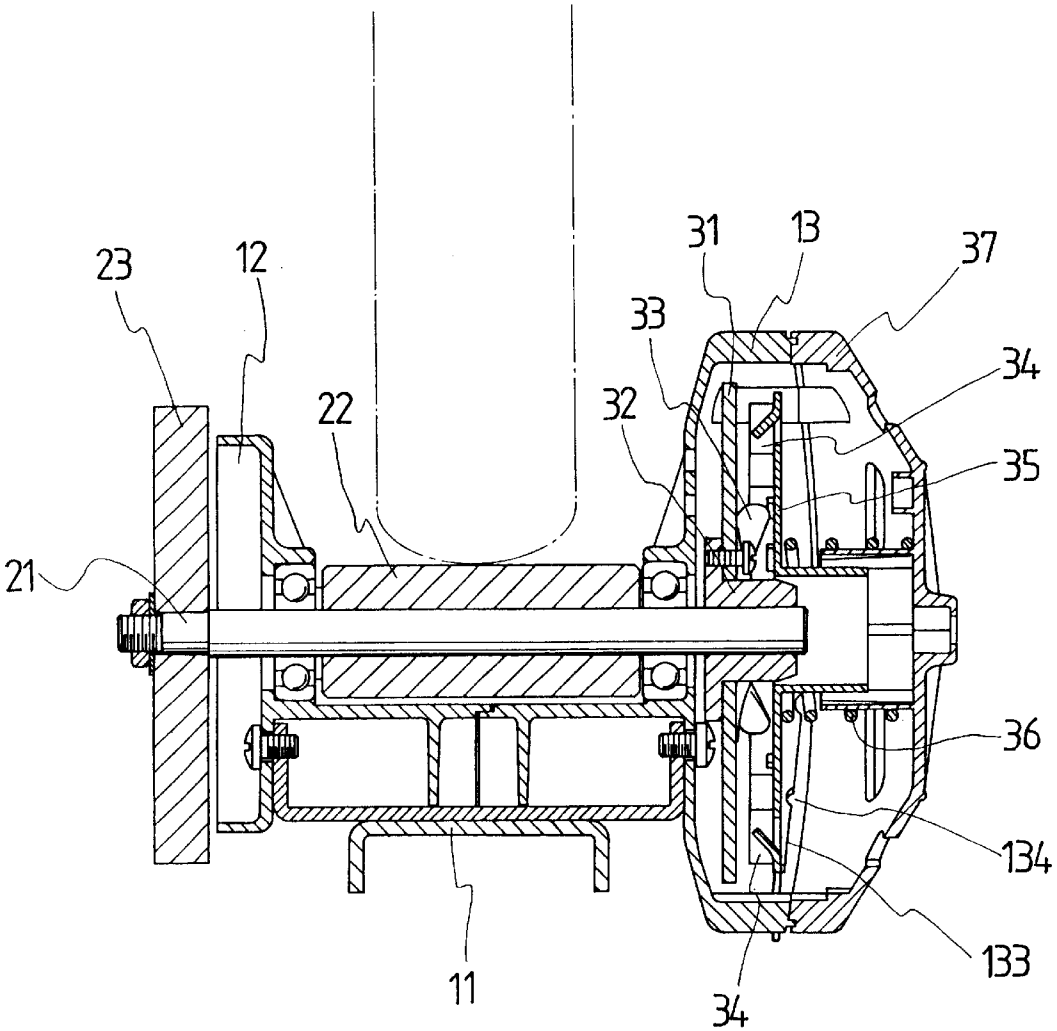
FIG. 7 is a schematic view showing the operation of the preferred embodiment of the present invention.

Both threaded rods 44 on the upper end of the frame 4 are turned for the inner ends of the retaining sleeves 46 to clamp onto both ends of a rear wheel shaft of the stationary bicycle. Then both fixation knobs 47 are tightened up to secure said threaded rods 44, thus the rear wheel of the stationary bicycle is lifted out of the ground and merely contacts the surface of the friction roller 22 of the transmission unit 2 as illustrated in FIG. 7. Accordingly, when the rear wheel is cycling, the friction roller 22 and the transmission shaft 21 are synchronously driven to cause the aluminum disk 31 to turn on one side of those magnets 34. Since said aluminum disk 31 turns in relation to the side of the magnet 34, a vortex magnetic loss effect is synchronously created to produce resistance to the turning of the transmission unit 2. The rider of the stationary bicycle has to apply more efforts to keep the rear wheel cycling, thus to achieve the fitness exercise purpose.

Now referring to FIG. 3, the adjustment of the amount of the resistance is achieved by changing the axial position of the upper ear 351 of the fixation disk 35 to rest on the slope 133. Said position of the upper ear 351 resting on the slop 133 is changed by pushing the control button 38 provided above the cover 37. Upon completing the adjustment, the upper ear 351 is clicked into the proper recess 134 to be held in position. By taking advantage of the upper ear 351 to move against the slope 133 and the plunging by the elastic member 36, the axial displacement of the fixation disk 35 can be adjusted as desired to control the spacing between the magnet 34 and the aluminum disk 31.

Furthermore, to maintain the strength and service life of each of all the members of the present invention, the fan 33 provided in front of the aluminum disk 31 of the magnetism-controlled unit 3 synchronously turns to directly dispense the heat generated from those magnets 34 and other members to avoid the cover 37 from getting overheated. To ensure firm and consistent operation of the transmission unit 2, the flywheel 23 is provided at one end of the transmission shaft 21 to avoid vibration and to help increase the resistance for emphasizing the training of the legs of the rider. To save storage space required by the stationary bicycle, the frame 4 can be folded up by means of those lateral rods 41' and struts 42'.

What is claimed is:

1. A resistance generator for stationary bicycles, the generator comprising a support unit, a transmission unit, a magnetism controlled unit and a frame, wherein, the support unit includes a base plate, a first support disk and a second support disk, the first support disk and the second support disk abut each other and are fixed on the base plate, the second support disk has a flange formed with a plurality of slopes;

the transmission unit is mounted on the support unit and includes a transmission shaft having two ends rotatably mounted in the first support disk and the second support disk respectively, and a cylindrical friction roller mounted on the transmission unit to rotate therewith;

the magnetism controlled unit includes an aluminum disk, multiple magnets, a fixation disk, an elastic member and a cover, the aluminum disk has a center formed with a through hole, the magnets are fixed to the fixation disk and are arranged to form a circle with interlaced magnetic north and south poles, the fixation disk has a circumference formed with a protruding ear, the elastic member is urged between the fixation disk and the cover, and the cover has a flange formed with a plurality slopes aligning with the slopes of the second support disk; and the frame is provided to support the support unit and lift a stationary bicycle;

wherein:

the aluminum disk of the magnetism controlled unit is fixed on the transmission shaft and located in the second support disk to rotate with the transmission shaft, the cover is fixed on the second support disk, the slopes of the cover and the second support disk form a plurality of slots, the ear of the fixation disk is extended through and protruded outward from one of the slots of the slopes of the cover and the second support disk to adjust an axial displacement of the fixation disk, an adjustable spacing is formed between the magnets and the aluminum disk to provide a variable resistance to a stationary bicycle when a rear wheel of the bicycle is rotated against the friction roller.

2. The resistance generator as claimed in claim 1, wherein, the base plate has an end formed with a T-shaped tab having two ends each formed with a connection bit.

3. The resistance generator as claimed in claim 1, wherein, the first support disk has a surface formed with an axial hole and has an end formed with a positioning block, the second support disk has a surface formed with an axial hole and has an end formed with a positioning block, the positioning blocks of the first support disk and the second support disk abut each other and are fixed on the base plate.

4. The resistance generator as claimed in claim 1, wherein, multiple recesses are formed in the slopes of the second support disk to fix the ear of the fixation disk.

5. The resistance generator as claimed in claim 1, wherein, a flywheel is fixed to the transmission shaft and located adjacent to the first support disk.

6. The resistance generator as claimed in claim 1, wherein, the aluminum disk of the magnetism controlled unit is fixed on a fixation ring, and the fixation ring is fixed on the transmission shaft.

7. The resistance generator as claimed in claim 1, wherein, a fan is fixed to a side of the aluminum disk of the magnetism controlled unit.

8. The resistance generator as claimed in claim 1, wherein, the fixation disk has a surface formed with a plurality of protruding curved positioning tabs to retain the magnets.

9. The resistance generator as claimed in claim 1, wherein, the ear protruding from the fixation disk is connected to a rectangular control button to adjust the axial displacement of the fixation disk.

10. The resistance generator as claimed in claim 1, wherein, the frame includes two lateral rods each provided with two struts, the two struts of one of the two lateral rods are pivotally connected with the two struts of the other one of the two lateral rods, each of the two struts of one of the two lateral rods is provided with a lateral tube, a threaded rod screwed into the lateral tube, a knob fixed to a first end of the threaded rod, a retaining sleeve mounted on a second end of the threaded rod, and a fixation knob screwed onto the second end of the threaded rod and located adjacent to the retaining sleeve.

* * * * *